US005954438A

United States Patent [19]

Klein et al.

[11] Patent Number: 5,954,438

[45] Date of Patent: Sep. 21, 1999

[54] SHEET PRESENTER AND METHOD OF USING SAME

[75] Inventors: Glenn F. Klein, Mission Viejo, Calif.; Guenter Rudolf Weist, DeiBlingen, Germany

[73] Assignee: BDT Products, Inc., Irvine, Calif.

[21] Appl. No.: 08/960,659

[22] Filed: Oct. 30, 1997

[51] Int. Cl.[6] ..... B41J 11/26

[52] U.S. Cl. ..... 400/621; 101/226; 235/379

[58] Field of Search ..... 400/621; 235/379; 101/226, 227, 224, 485

[56] References Cited

U.S. PATENT DOCUMENTS

| | | | |
|---|---|---|---|
| 3,417,681 | 12/1968 | Lemelson | 400/621 |
| 4,397,455 | 8/1983 | Hickey . | |
| 4,560,990 | 12/1985 | Sue et al. | 400/621 |
| 4,564,122 | 1/1986 | Granaow et al. . | |
| 4,577,763 | 3/1986 | Placke et al. . | |
| 4,578,009 | 3/1986 | Granzow et al. . | |
| 5,215,393 | 6/1993 | Wincent | 400/621 |
| 5,413,426 | 5/1995 | Ijuin et al. | 400/621 |
| 5,478,161 | 12/1995 | Suzuki et al. | 400/621 |
| 5,649,776 | 7/1997 | Sugimoto et al. | 400/621 |
| 5,699,741 | 12/1997 | Schmidt et al. | 400/621 |
| 5,767,984 | 6/1998 | Momonani | 400/621 |

*Primary Examiner*—Eugene Eickholt
*Attorney, Agent, or Firm*—Higgs, Fletcher & Mack LLP; Bernard L. Kleinke

[57] ABSTRACT

The sheet presenter includes a housing having a feed path therethrough from a feed end to a presenting end, and which defines an escrow area between the feed end and the presenting end. Presenting rollers at the presenting end initially restrain forward movement of a continuous sheet along the feed path, and cooperate with a gate to divert the sheet from the feed path into the escrow area to enable the sheet to be accumulated in the escrow area as the sheet is being imprinted. Subsequently, the presenting rollers urge the imprinted portion of the sheet out of the escrow area to present the imprinted portion. The presenting rollers are de-clutched to allow the recipient to grab the imprinted portion and pull it out without damaging the mechanism or the remaining sheet.

17 Claims, 2 Drawing Sheets

SHEET PRESENTER AND METHOD OF USING SAME

CROSS-REFERENCE TO RELATED APPLICATIONS

This patent application is related to U.S. patent application Ser. No. 08/960,658 entitled "ROTARY CUTTING APPARATUS AND METHOD OF USING SAME" and filed concurrently herewith, which application is incorporated by reference as if fully set forth herein.

BACKGROUND OF THE INVENTION

1. Technical Field

The present invention relates in general to an improved sheet presenter and a method of using it. The invention more particularly relates to a sheet presenter for dispensing a sheet according to a novel method.

2. Background Art

Printing apparatuses for imprinting a sheet and delivering the imprinted sheet to a user are well known. For example, kiosks and other remote unmanned stations, such as automated teller machines and fuel dispensing pumps, have utilized such printing apparatuses to record user transactions, and to provide the user with a written record or receipt for the transaction.

Generally, such printing apparatuses have included a printing unit having a paper feed path and a roll of continuous paper sheet material supplied to the printing unit through the paper feed path. The printing unit was activated to imprint a portion of the continuous paper sheet. As the printing unit imprinted the portion, the portion was continually fed along the paper feed path toward a receptacle. Upon completion of the printing job, the imprinted portion was separated from the rest of the continuous paper sheet by a cutting apparatus and deposited in the receptacle where the user could access the printed receipt. Delivery of the receipt to the receptacle was accomplished by a downwardly sloping ramp extending from the cutting apparatus to the receptacle, or by presenting rollers.

Although such printing apparatuses enabled a user to obtain a printed receipt for a transaction, such apparatuses were somewhat long to accommodate a paper feed path having a sufficient length to deliver the paper sheet from the roll to the printer unit, through the cutting apparatus and along the ramp or through the presenting rollers to the receptacle for presenting the receipt to the user. Thus, the depth of the kiosks and unmanned stations utilizing the known printing apparatuses had to be sufficient to receive the printing apparatuses therein.

Furthermore, the prior known printing apparatuses were susceptible to disruptive occurrences caused by the user grasping and pulling the receipt as it arrived in the receptacle. Upon seeing the receipt arrive in the receptacle, the user was tempted to remove the receipt before the printing job was complete, and before the imprinted receipt portion was separated from the remaining continuous paper sheet. Consequently, the kiosk or unmanned station was rendered inoperable until the disruption to the printing apparatus was returned to working order.

Therefore, it would be highly desirable to have a new and improved sheet presenter for use with a printing apparatus to render the printing apparatus substantially compact. Such a sheet presenter should present the sheet without disrupting the operation of the printing apparatus according to a novel method.

SUMMARY OF THE INVENTION

Therefore, the principal object of the present invention is to provide a new and improved sheet presenter for a printing apparatus, and a method of using it, wherein the printing apparatus is able to be substantially compact, and wherein the occurrence of a disruption is substantially reduced.

Briefly, the above and further objects of the present invention are realized by providing a new and improved sheet presenter, which can be used with a printing apparatus according to a novel method to present individual sheets from a continuous sheet.

The sheet presenter includes a housing having a feed path therethrough from a feed end to a presenting end, and which defines an escrow area between the feed end and the presenting end. Presenting rollers at the presenting end initially restrain forward movement of a continuous sheet along the feed path, and cooperate with a gate to divert the sheet from the feed path into the escrow area to enable the sheet to be accumulated in the escrow area as the sheet is being imprinted. Subsequently, the presenting rollers urge the imprinted portion of the sheet out of the escrow area to present the imprinted portion. The presenting rollers are de-clutched to allow the recipient to grab the imprinted portion and pull it out without damaging the mechanism or the remaining sheet.

BRIEF DESCRIPTION OF THE DRAWINGS

The above mentioned and other objects and features of this invention and the manner of attaining them will become apparent, and the invention itself will be best understood by reference to the following description of the embodiment of the invention in conjunction with the accompanying drawings, wherein.

BEST MODE FOR CARRYING OUT THE INVENTION

Figure 1:
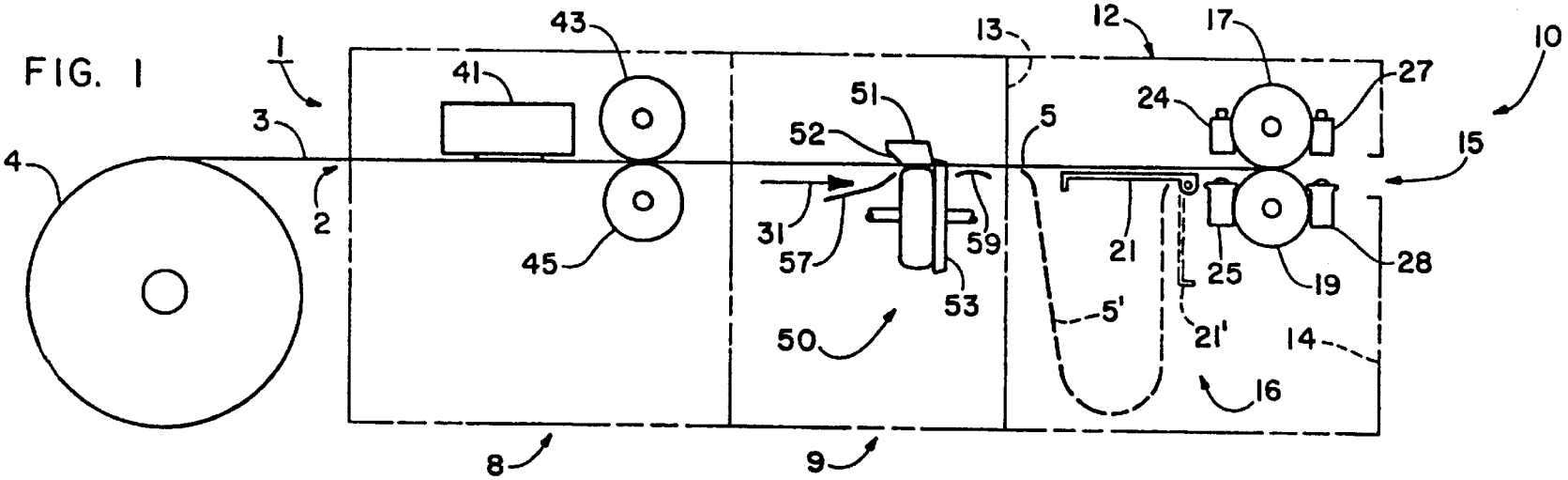
FIG. 1 is a diagrammatic view of a paper sheet printing assembly for imprinting an imprinted portion of a continuous paper sheet illustrating the movement of the continuous paper sheet through the printing assembly prior to the separation of the imprinted portion from the remainder of the continuous paper sheet, the assembly including a sheet presenter which is constructed in accordance with the present invention.

Referring now to the drawings, there is shown a paper sheet printing apparatus 1 for imprinting a continuous paper sheet 3 dispensed from a roll 4 as the sheet 3 travels along a paper path 2. The printing apparatus 1 includes a printing assembly 8 for imprinting a leading or imprinted portion 5 of the sheet 3, a cutting assembly 9 for separating the imprinted portion 5 from a retained or remaining portion 6 of the sheet 3, and a sheet presenter assembly 10 for presenting the separated imprinted portion 5 to a user (not shown).

The printing assembly 8 includes a printing unit 41 for imprinting the sheet 3 according to a print job with indicia at the imprinted portion 5, and a pair of printer feed rollers 43 and 45 for engaging the sheet 3 therebetween. The rollers 43 and 45 urge the sheet 3 along the feed path 2 in a forward direction indicated by the arrow 31 (FIG. 1) to move the imprinted portion 5 to the presenter assembly 10. As will be described hereinafter in greater detail, the rollers 43 and 45 also urge the sheet 3 rearwardly along the feed path 2 as indicated by the arrow 33 (FIG. 2) after the imprinted portion 5 is separated from the remaining portion 6.

Figure 3:
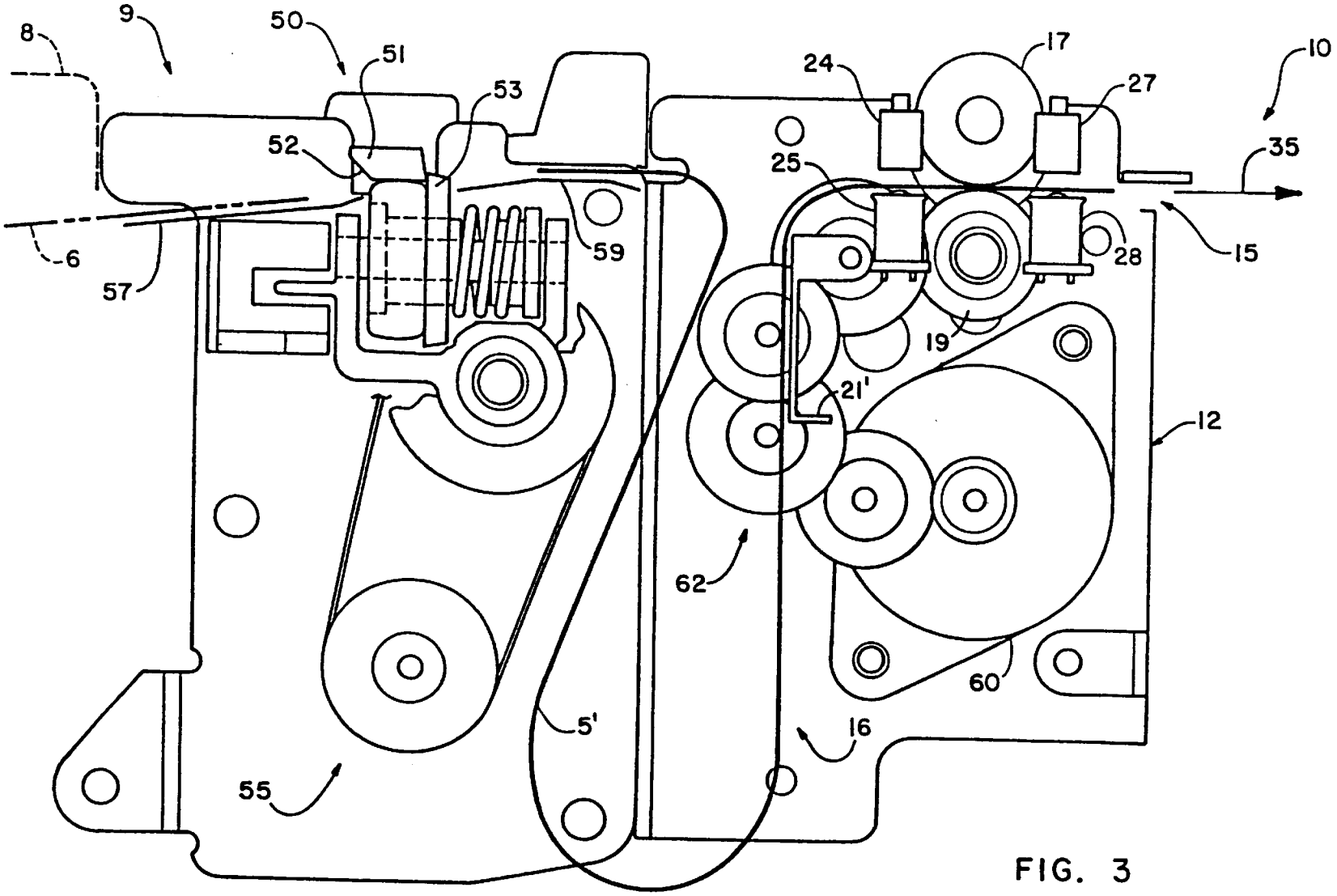
FIG. 3 is an enlarged elevation view of the sheet presenter of FIG. 1.

The cutting assembly 9 is disposed along the path 2 intermediate the printing assembly 8 and the presenter assembly 10, and includes a cutting arrangement 50 having a transverse cutting bar 51 and a rolling cutter member 53 for separating the imprinted portion 5 from the remaining portion 6. A preferred cutting arrangement 50 is described in co-owned and co-pending U.S. patent application Ser. No. 08/960,658 which description is incorporated by reference as if fully set forth herein. A cutter drive assembly 55 (FIG. 3) drives the rolling cutter 53 relative to the cutting bar 51 to separate the imprinted portion 5 from the remaining portion 6.

An undercut surface 52 of the cutting bar 51 cooperates with a paper feed guide 57 to guide the imprinted portion 5 of the sheet 3 between the cutting bar 51 and the cutter member 53. A paper exit guide 59 guides the imprinted portion 5 from the cutting arrangement 50 to the presenter assembly 10.

The sheet presenting assembly 10 includes a housing 12 having a feed end 13 and a presenting end 14 for defining the feed path 2 through the sheet presenter assembly 10. The housing 12 further defines an escrow area 16 between the presenting end 14 and the feed end 13, and adjacent to the feed path 2, for accumulating the imprinted portion 5 as a temporarily stored or escrowed imprinted portion 5' indicated in dashed lines in FIG. 1. An opening 15 through the presenting end 14 enables the stored imprinted portion 5' to be presented out of the assembly 10 to the user.

A pair of de-clutchable presenter feed rollers 17 and 19 are disposed along the feed path 2 at about the presenting end 14 for controlling the storing and presenting of the stored imprinted portion 5'. A gate 21 is pivotable between an open position and a closed position to block off the escrow area 16 as the imprinted portion 5 is guided along the path 2 to engage the rollers 17 and 19, and is responsive to the imprinted portion 5 reaching the rollers 17 and 19 to permit the imprinted portion 5 to be accumulated in the escrow area 16 as stored imprinted portion 5'.

The entire printing apparatus 1 utilizes only two pairs of drive rollers, print rollers 43 and 45 and presented rollers 17 and 19, to print and deliver the imprinted portion 5 to the user. Thus, the overall cost of the apparatus 1 is substantially reduced.

In operation, the sheet 3 is fed from the roll 4 along the feed path 2 into the printing assembly 8 to an initial printing position (not shown). The printing unit 41 is activated to imprint the imprinted portion 5 with indicia. During the printing job, the rollers 43 and 45 and urge the sheet 3 in the forward direction to imprint the imprinted portion 5 along its longitudinal length. The rollers 43 and 45 continue to urge the imprinted portion 5 forwardly through the cutting assembly 9 and into the sheet presenter assembly 10.

Figure 2:
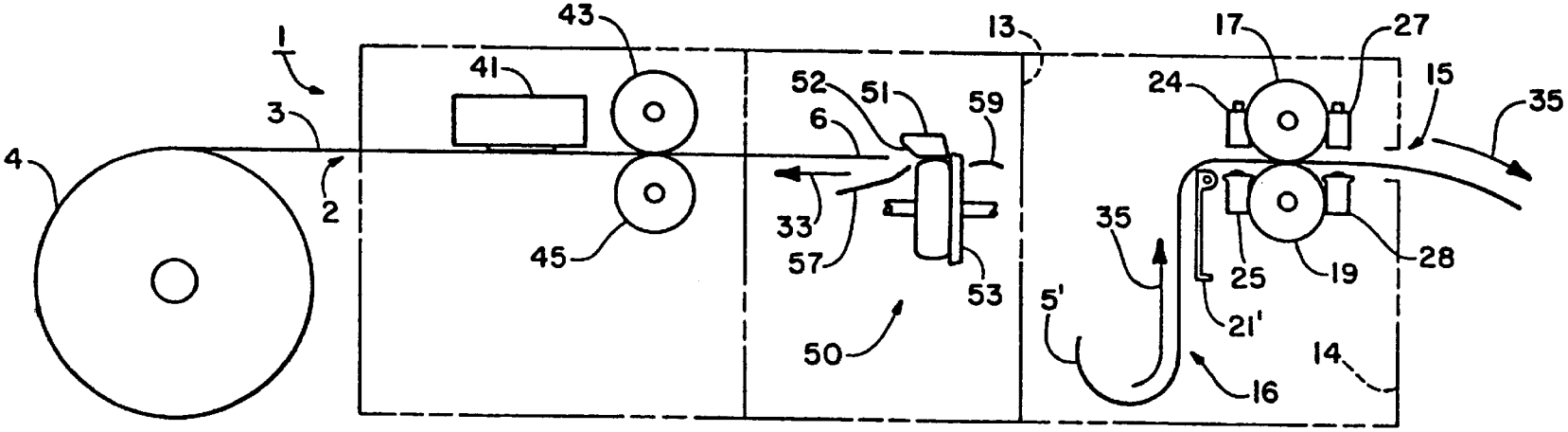
FIG. 2 is a diagrammatic view of the sheet printing assembly of FIG. 1 illustrating the movement of the imprinted portion and the remainder of the continuous paper sheet after the imprinted portion is separated from the continuous sheet, and the presenting of the separated imprinted portion by the sheet presenter of FIG. 1.

As the imprinted portion 5 travels through the assembly 10 from the feed end 13, the initially closed gate 21 indicated by solid lines in FIG. 1 guides the imprinted portion 5 along the path 2 until a leading edge portion of the imprinted portion 5 reaches the presenting end 14 and the rollers 17 and 19. As the imprinted portion 5 is guided to the rollers 17 and 19, the closed gate 21 substantially blocks access to the escrow area 16.

A nip defined by the rollers 17 and 19 frictionally retains the leading edge portion to support the imprinted portion 5 at the presenting end 14. The closed gate 21 is responsive to the imprinted portion 5 reaching the presenting end 14 at about the rollers 17 and 19 to pivot the closed gate 21 to an open position. The open gate 21' is indicated by dashed lines in FIG. 1. The open gate 21' enables the imprinted portion 5 to sag into the escrow area 16. As a result of the nip retaining the leading edge and stopping the advancement thereof, the imprinted portion 5 is diverted out of the path 2 and into the escrow area 16 as the rollers 43 and 45 continue to feed the sheet 3 for temporarily storing the imprinted portion 5 as stored imprinted portion 5'.

The rollers 43 and 45 continue to urge the imprinted portion 5 into the escrow area 16 as the imprinted portion 5 receives the indicia thereon from the printing unit 41. Upon completion of the print job, the rollers 43 and 45 further urge the imprinted portion 5 along the path 2 until the indicia is positioned substantially forwardly of the cutting arrangement 50. Once the indicia on the imprinted portion 5 is positioned forwardly of the cutting arrangement 50, the rolling cutter 53 is driven by the arrangement 55, and in cooperation with the bar 51, to separate the stored imprinted portion 5' from the remaining portion 6.

After separation from the remaining portion 6, the stored imprinted portion 5' (FIGS. 2 and 3) is urged forwardly by the rollers 17 and 19 in the direction indicated by arrows 35 to present the imprinted portion 5' out of the opening 15 to the user. The open gate 21' helps guide the stored imprinted portion 5' out of the escrow area 16 to the opening 15. The rollers 17 and 19 are de-clutched to permit the user to pull the imprinted portion 5' out of the opening 15 while the imprinted portion 5' is being presented.

Substantially concurrently with the presenting of the imprinted portion 5' through the opening 15, the remaining portion 6 is urged rearwardly by the rollers 43 and 45 along the path 2 as indicated by the arrow 33. The rollers 43 and 45 continue to urge the remaining portion 6 rearwardly until the remaining portion 6 is returned to the initial printing position relative to the printing unit 41 for receiving indicia for a subsequent print job. Once the imprinted portion 5' is presented, the open gate 21' is returned to the closed position for enabling the closed gate 21 to guide a subsequent imprinted portion (not shown).

Considering now the sheet presenting assembly 10 in greater detail, the assembly 10 further includes an upper paper entrance sensor unit 24 and a lower paper entrance sensor 25 to detect the presence of the imprinted portion 5 at about the nip of the rollers de-clutching 17 and de-clutching 19. The sensors 24 and 25 are spaced apart across the path 2 to detect the sheet 3 therebetween, and may include photosensors or any other suitable detection sensors. The closed gate 21 is responsive to the detection of the imprinted portion 5 at about the presenting end 14 by the sensors 24 and 25 to pivot the closed gate 21 to the open gate position as the open gate 21'. The assembly 10 further includes an upper paper exit sensor 27 and a lower paper exit sensor 28, similar to sensors 24 and 25, which cooperate with one another to detect the imprinted portion 5' as it is presented through the opening 15 to facilitate pivoting the open gate 21' to the closed position. A motor 60, and a gear assembly 62 coupled operatively to the motor 60, drive the rollers 17 and 19 to control the presenting of the stored imprinted portion 5'.

While particular embodiments of the present invention have been disclosed, it is to be understood that various different modifications are possible and are contemplated within the true spirit and scope of the appended claims. There is no intention, therefore, of limitations to the exact abstract or disclosure herein presented.

What is claimed is:

1. A sheet presenter comprising:

housing means having a presenting end, an opening at said presenting end, and a feed end, for defining a feed path along which the sheet initially travels as it is fed from said feed end to said presenting end, and for defining an escrow area adjacent to said feed path between said presenting end and said feed end;

drive means disposed in said feed path at about said presenting end for engaging the sheet to limit the travel of the sheet along said feed path for facilitating the continuous accumulation of the sheet within said escrow area as the sheet is fed continuously from said feed end, and for urging the sheet out of said escrow area through said opening after the feeding of the sheet has ceased; and diverting means for selectively blocking access to said escrow area to help guide the sheet along said feed path, said diverting means being responsive to the sheet reaching said presenting end for permitting the sheet to be diverted out of said feed path into said escrow area to enable the sheet to be accumulated as the sheet is fed to temporarily store the sheet prior to said drive means urging the sheet out of said opening.

2. A presenter according to claim 1, further including sensing means for detecting the sheet reaching said presenting end.

3. A presenter according to claim 1, wherein said drive means includes a pair of drive rollers.

4. A presenter according to claim 1, wherein said diverting means includes a gate pivotable between a blocking position and an access position.

5. A presenter according to claim 1, further including a cutting means disposed in said feed path for separating the sheet into an imprinted portion and a retained portion when the feeding of the sheet ceases, wherein said imprinted portion is accumulated in said escrow area as the sheet is fed continuously and is presented through said opening by said drive means after the sheet is separated.

6. A presenter according to claim 5, wherein said drive means is responsive to the sheet being separated to urge said imprinted portion out of said escrow area to present said imprinted portion.

7. A presenter according to claim 5, further including printing means for imprinting the imprinted portion, and printer drive means for urging the imprinted portion through said feed end to said presenting end, wherein said printer drive means is responsive to said separation of the sheet to retract said retained portion to a printing position.

8. A presenter according to claim 7, further including sensing means for detecting the presenting of said imprinted portion.

9. A method of presenting a sheet, comprising:

using a housing defining a feed end, presenting end, a feed path therebetween for guiding the sheet, and an escrow area for temporarily storing the sheet, said housing including an opening at about said escrow area for presenting the sheet therethrough;

imprinting a portion of the sheet, said imprinted portion having a leading portion;

urging the imprinted portion in a forward direction along said feed path until said leading portion becomes disposed at said presenting end;

stopping the leading portion at said presenting end;

continuing to urge said imprinted portion in said forward direction to cause said imprinted portion to sag into said escrow area;

separating said imprinted portion from the sheet to facilitate presenting said imprinted portion;

urging with a roller means said separated imprinted portion out of said escrow area through said opening in response to the sheet being separated; and declutching said roller means when a user pulls said separated imprinted portion from said opening, thereby enabling the user to remove said separated imprinted portion from said opening without damaging said roller means or said separated imprinted portion.

10. A sheet presenter according to claim 9, further including sensing said imprinted portion at about said presenting drive means.

11. A method of presenting a sheet, comprising:

using a housing defining a feed end, presenting end, a feed path therebetween for guiding the sheet, and an escrow area for temporarily storing the sheet, said housing including an opening at about said escrow area for presenting the sheet therethrough;

imprinting a portion of the sheet, said imprinted portion having a leading portion;

urging the imprinted portion in a forward direction along said feed path until said leading portion becomes disposed at said presenting end;

stopping the leading portion at said presenting end;

continuing to urge said imprinted portion in said forward direction to cause said imprinted portion to sag into said escrow area;

separating said imprinted portion from the sheet to facilitate presenting said imprinted portion;

urging said separated imprinted portion out of said escrow area through said opening in response to the sheet being separated;

sensing said imprinted portion at about said presenting drive means;

selectively blocking access to said escrow area to help guide the sheet along said feed path; and permitting said imprinted portion to be accumulated in said escrow area when said imprinted portion is sensed to enable said imprinted portion to be stored temporarily.

12. A sheet presenter according to claim 11, further including urging the sheet in a reverse direction to an initial print position after said imprinted portion is separated.

13. A compact printing apparatus for a continuous sheet, comprising:

housing means for helping to define a feed path for guiding the sheet and an escrow area for temporarily storing the sheet, said housing means including an opening at about said escrow area for presenting the sheet therethrough;

printing means disposed along said feed path for imprinting a portion of the sheet;

drive means for urging the sheet along the feed path, said drive means including feed drive means disposed at said feed path for controlling the movement of the sheet along said feed path to feed said printed portion in a forward direction along the feed path;

said drive means further including presenting drive means disposed at said feed path spaced apart from said feed drive means and adjacent to said opening for controlling the movement of said printed portion to stop the movement of said printed portion in said forward direction for accumulating said printed portion in said escrow area as said feed drive means continues to feed the sheet;

said presenting drive means further comprising a pair of de-clutchable rollers;

cutting means disposed at said feed path intermediate said feed drive means and said presenting drive means for separating said printed portion from the sheet to facilitate presenting the printed portion; and said presenting means being responsive to said separation of said printed portion from the sheet to urge said printed portion out of said escrow area through said opening, the de-clutchable rollers causing said separated printed portion to be removed by the user from said printing apparatus without damaging said printing apparatus or said separated printed portion.

14. A compact printer apparatus according to claim 13, further including sensing means for sensing said printed portion at about said presenting drive means.

15. A compact printing apparatus for a continuous sheet, comprising:

housing means for helping to define a feed path for guiding the sheet and an escrow area for temporarily storing the sheet, said housing means including an opening at about said escrow area for presenting the sheet therethrough;

printing means disposed along said feed path for imprinting a portion of the sheet;

drive means for urging the sheet along the feed path, said drive means including feed drive means disposed at said feed path for controlling the movement of the sheet along said feed path to feed said printed portion in a forward direction along the feed path;

said drive means further including presenting drive means disposed at said feed path spaced apart from said feed drive means and adjacent to said opening for controlling the movement of said printed portion to stop the movement of said printed portion in said forward direction for accumulating said printed portion in said escrow area as said feed drive means continues to feed the sheet;

cutting means disposed at said feed path intermediate said feed drive means and said presenting drive means for separating said printed portion from the sheet to facilitate presenting the printed portion;

said presenting means being responsive to said separation of said printed portion from the sheet to urge said printed portion out of said escrow area through said opening; and further including diverting means for selectively blocking access to said escrow area to help guide the sheet along said feed path, said diverting means being responsive to said sensing means for permitting said printed portion to sag out of said feed path into said escrow area to enable said printed portion to be stored temporarily.

16. A compact printer apparatus according to claim 15, wherein said feed drive means is responsive to the separation of said printed portion from the sheet to urge the sheet in a reverse direction to an initial print position relative to said printing means.

17. A compact printer apparatus according to claim 13, wherein said drive means includes two pairs only of drive rollers including a pair of feed drive rollers and a pair of presenting drive rollers.

* * * * *